US011761720B2

(12) United States Patent
Kastrun

(10) Patent No.: US 11,761,720 B2
(45) Date of Patent: Sep. 19, 2023

(54) CARBINE HAVING A CHARGING HANDLE

(71) Applicant: GLOCK TECHNOLOGY GMBH, Ferlach (AT)

(72) Inventor: Mario Kastrun, Maria Rain (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 0 days.

(21) Appl. No.: 17/753,843

(22) PCT Filed: Sep. 30, 2020

(86) PCT No.: PCT/EP2020/077370
§ 371 (c)(1),
(2) Date: Mar. 16, 2022

(87) PCT Pub. No.: WO2021/064023
PCT Pub. Date: Apr. 8, 2021

(65) Prior Publication Data

US 2022/0357118 A1 Nov. 10, 2022

(30) Foreign Application Priority Data

Oct. 4, 2019 (EP) ..... 19201448

(51) Int. Cl.
*F41A 3/72* (2006.01)
*F41A 17/38* (2006.01)
*F41A 35/06* (2006.01)

(52) U.S. Cl.
CPC ..... *F41A 3/72* (2013.01); *F41A 17/38* (2013.01); *F41A 35/06* (2013.01)

(58) Field of Classification Search
CPC ..... F41A 3/72; F41A 35/06; F41A 17/38
See application file for complete search history.

(56) References Cited

U.S. PATENT DOCUMENTS 3,323,418 A * 6/1967 Loffler ..... F41A 5/26 89/193
6,508,158 B2 * 1/2003 Murello ..... F41A 3/72 89/1.42

(Continued)

FOREIGN PATENT DOCUMENTS

DE 1453918 A1 9/1969
DE 1902275 A1 7/1970

(Continued)

OTHER PUBLICATIONS

EP Search Report Intl. Appl. No. PCT/EP2020/077370, dated Dec. 4, 2020.

*Primary Examiner* — Joshua E Freeman
(74) *Attorney, Agent, or Firm* — Raven Patents, LLC; Anton E. Skaugset

(57) ABSTRACT

A rifle having a central weapon plane, comprising a barrel that has a barrel bore axis, a gas drive, a bolt carrier, a recoil spring unit and a charging handle unit arranged in front of the bolt carrier, wherein the charging handle unit comprises at least one handle, which is mounted on a slider element for rotation about pivot pins and is forcibly displaced about a pivot pin into its rest position by at least one handle spring, and the slider element is mounted in a carriage which is arranged axially in front of the bolt carrier and is movable in the axial direction. The rifle is characterized in that the at least one handle comprises an elongate hole for receiving the pivot pins and for the support by said pins.

16 Claims, 8 Drawing Sheets

(56) References Cited

U.S. PATENT DOCUMENTS

| | | | | |
|---|---|---|---|---|
| 7,231,861 | B1 * | 6/2007 | Gauny | F41A 3/72 89/1.4 |
| 7,240,600 | B1 | 7/2007 | Bordson | |
| D590,473 | S * | 4/2009 | Fitzpatrick | F41A 3/72 D22/103 |
| D606,614 | S * | 12/2009 | Fitzpatrick | F41A 3/72 D22/103 |
| 7,798,045 | B1 * | 9/2010 | Fitzpatrick | F41A 21/481 89/1.4 |
| 8,156,854 | B2 * | 4/2012 | Brown | F41A 3/72 89/1.4 |
| 8,468,929 | B2 * | 6/2013 | Larson | F41A 35/06 89/193 |
| 8,561,517 | B2 * | 10/2013 | Brown | F41A 3/72 89/1.4 |
| 8,899,138 | B2 * | 12/2014 | Brown | F41A 3/72 89/1.4 |
| 8,997,620 | B2 * | 4/2015 | Brown | F41A 7/00 89/1.4 |
| 9,109,848 | B2 | 8/2015 | Brown | |
| 9,366,489 | B1 | 6/2016 | Strom | |
| 9,377,257 | B2 * | 6/2016 | Foster | F41A 3/72 |
| 9,400,147 | B2 * | 7/2016 | Larson, Jr. | F41A 21/34 |
| 9,733,030 | B2 | 8/2017 | Daniel | |
| 10,352,635 | B2 * | 7/2019 | Noonan | F41C 23/16 |
| 10,598,451 | B1 * | 3/2020 | Haidu | F41A 3/72 |
| 11,073,350 | B2 * | 7/2021 | Meier | F41A 3/66 |
| 2002/0046642 | A1 * | 4/2002 | Murello | F41A 35/06 89/1.42 |
| 2010/0000396 | A1 * | 1/2010 | Brown | F41A 7/02 89/1.4 |
| 2010/0000400 | A1 * | 1/2010 | Brown | F41A 5/18 42/111 |
| 2011/0083551 | A1 * | 4/2011 | Sirochman | F41A 5/18 89/1.4 |
| 2013/0061737 | A1 * | 3/2013 | Brown | F41A 3/72 89/1.4 |
| 2015/0260468 | A1 * | 9/2015 | Foster | F41A 5/26 89/191.01 |
| 2016/0047614 | A1 * | 2/2016 | Larson, Jr. | F41G 11/003 89/191.01 |
| 2017/0138682 | A1 * | 5/2017 | Larson, Jr. | F41A 3/72 |
| 2017/0321978 | A1 * | 11/2017 | Brannan | F41A 3/70 |
| 2019/0056189 | A1 * | 2/2019 | Lowe | F41C 27/00 |
| 2019/0154382 | A1 * | 5/2019 | Pizano | F41A 3/72 |
| 2021/0180896 | A1 * | 6/2021 | Noonan | F41A 3/66 |

FOREIGN PATENT DOCUMENTS

| | | | |
|---|---|---|---|
| DE | 3928125 | A1 | 2/1991 |
| DE | 102018001984 | A1 | 9/2021 |
| WO | 2008140833 | A1 | 11/2008 |

* cited by examiner a)
b)
c)
d)
19
20
21
22
23
24
25
26
28
29
30
31
35
37
38
39
43

35
28
20
23a,b
24
38
37
22
36
40
41
30
21a
21b

CARBINE HAVING A CHARGING HANDLE

TECHNICAL FIELD

The present disclosure relates to firearms, and more particularly to rifles having a charging handle assembly.

BACKGROUND

Charging handles are provided for carbines (that is, rifles) so that the firearm can be cocked manually; if there is no cartridge in the cartridge chamber, for example, and a new magazine has been inserted, the bolt may be pulled backward by means of the charging handle, thus tensioning the recoil spring. During the forward movement, the cartridge is drawn from the magazine, pushed into the cartridge chamber and the bolt is locked. When the recoil spring is tensioned, these processes usually take place by means of the recoil spring. In various cases, however, it may be necessary to manually move the charging handle forward, for example in order to push the bolt forward in case of a cartridge jam, or if the force of the return spring/recoil spring is insufficient to close the bolt and allow the next round to be fired. For the latter activity, in many cases a separate device, which is referred to as a "forward assist" in professional circles, may be provided, but it is more desirable to have a charging handle that allows both activities Charging handles are preferably operable by both left-handed and right-handed people alike (ambidextrous), which, unlike in the past, is being increasingly taken into consideration. It is also preferred for the charging handle to be in front of the bolt carrier (on the muzzle side), otherwise it is difficult to operate it when the firearm is ready to fire. Charging handles which are provided behind the bolt carrier make it necessary in such a case to act just in front of the face, which is cumbersome and, above all, results in poor arm positioning for the operator.

The charging handle should also not take part in the normal sequence of movement of the bolt carrier and bolt as this increases the mass of those moving parts and makes it necessary to provide stronger springs, and thus to ensure a stronger introduction of forces via the gas drive, which in turn increases the forces acting overall which makes the firearm as a whole more unsteady.

Finally, the charging handle should also change the outer contour of the firearm as little as possible, and above all should not have any protruding parts that can lead to obstructions and problems, especially in the field.

Numerous proposals are known from the prior art, the most important of which will be briefly discussed below. The content of the following documents, and all English-language documents mentioned in the description, is hereby incorporated by reference into the content of the present application:

| | | |
|---|---|---|
| U.S. 8,156,854 B2, | U.S. 9,109,848 B2, | U.S. 9,366,489 B1 |
| U.S. 8,899,138 B2, | U.S. 7,240,600 B1, | |
| U.S. 8,561,517 B2, | U.S. 9,733,030 B2, | |

U.S. Pat. No. 8,156,854 B2 discloses a rifle comprising a charging handle which, in a first embodiment, can optionally be mounted on a suitable mechanism on the right or left side of the barrel, with the conversion requiring total disassembly of the firearm. For reasons of strength, a different receiver or housing can also be provided during the conversion, since the handle of the charging handle protrudes through a long, slot-shaped recess in the receiver. In a variant according to FIG. 15 *ff*., a symmetrical design with two charging handles is provided. In both cases, the handle, via a carriage-like component, acts on the gas drive of the firearm, which drive is therefore subjected to high pressure during retraction against at least the force of the recoil spring, if not additionally against the resistance of dirt and the like, and this, due to the length of said drive, requires a much more massive design than would be required without this additional function. In order to not take part in the usual movement during the normal firing of shots, the handle engages with a pin in a lateral recess in the casing of the gas drive only when it is rotated about an axis and is thus in the action position. This results in an unpleasant dynamic situation, especially for such an action which is usually carried out with great force, and, as in particular shown by FIGS. 10 and 15 of the publication, this is highly susceptible to dirt retention.

Another solution is known from U.S. Pat. No. 8,899,138 B2, in which the introduction of force does not act on the gas drive, but on a special extension in the bolt, which thereby becomes significantly more massive, with the disadvantages mentioned above. Here, too, the handle protrudes through the receiver, and although a diagram indicates the possibility of providing the receiver with two corresponding recesses in order to make the conversion easier, this is hardly feasible in practice for mechanical reasons.

DE 39 28 125 A1 discloses a foldable handle as the handle of a charging handle, and deals almost exclusively with this, and this is significant because it involves a charging handle that moves with the bolt.

There is therefore a need for a charging handle which at least largely avoids the above-mentioned disadvantages and exhibits the desired properties mentioned at the outset at least to a degree. The aim of the present disclosure is to provide such a charging handle and also to ensure that handling is as simple as possible and that the number of parts of the charging handle assembly is minimal.

SUMMARY

The above-referenced aims are achieved by the charging handles of the present disclosure, which include at least one handle having a slot hole which is used to receive and mount a pin. The handle can thus be pivoted about the pin within limits between an idle position and a work position about the pin and can be used for both the return movement and the forward movement.

In one example, the disclosure is directed to a firearm having a weapon median plane, the firearm including a barrel with a barrel direction; a gas drive; a bolt carrier; a recoil spring assembly; and a charging handle assembly arranged in front of the bolt carrier; where the charging handle assembly has at least one handle that is mounted on the charging handle assembly body so as to be rotatable about a corresponding pin, and which is pushed by at least one handle spring about the corresponding pin into its idle position; and where the charging handle assembly body is mounted in a carriage that is arranged axially in front of the bolt carrier and is movable in the axial direction; and where the at least one handle defines a slot hole for receiving and being mounted upon its corresponding pin.

BRIEF DESCRIPTION OF THE DRAWINGS

The charging handles of the present disclosure are explained in more detail below with reference to the drawings, in which.

DETAILED DESCRIPTION

Figure 1:
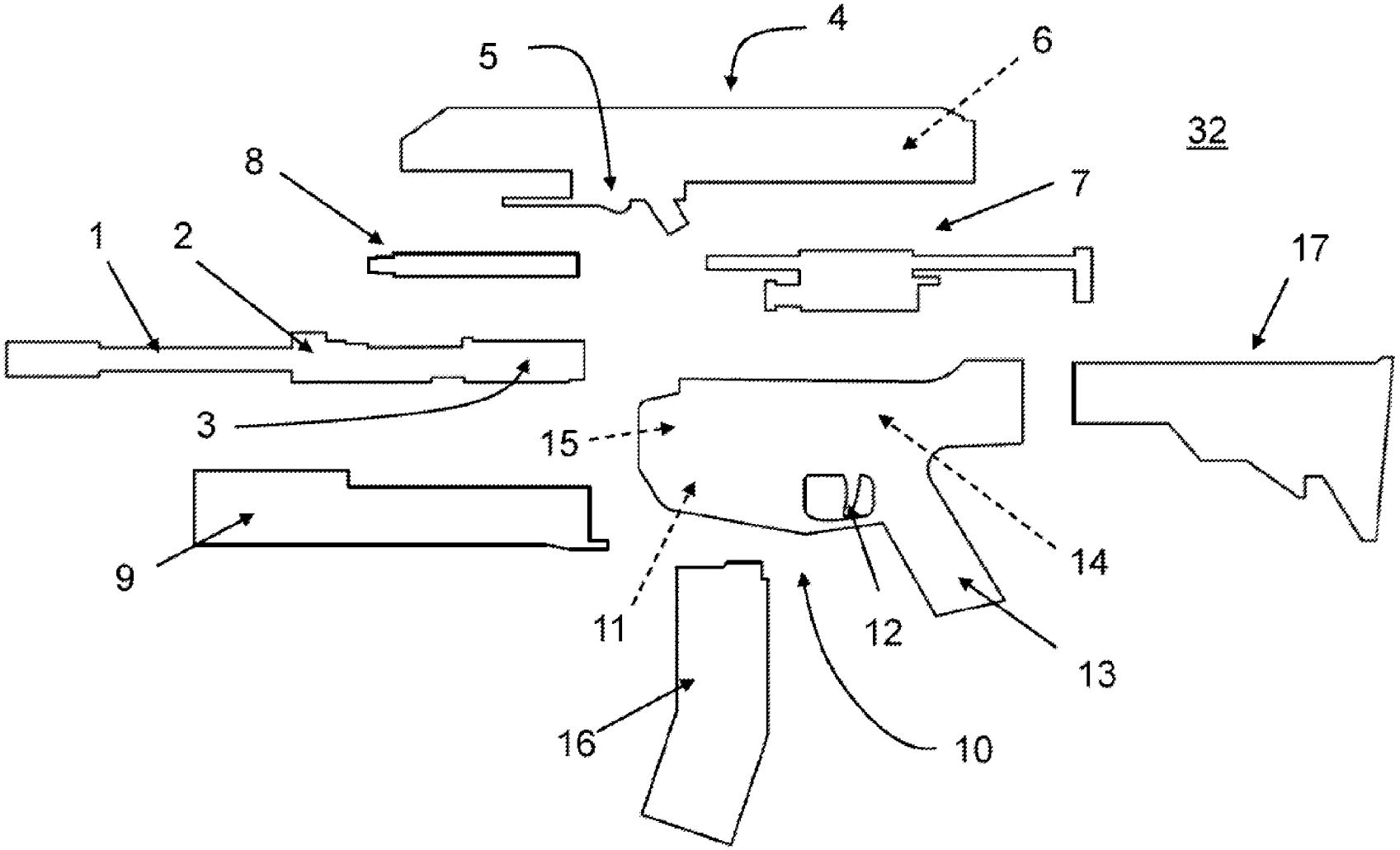
FIG. 1 is an overview of a largely modular weapon.

In the description and the claims, the terms "front," "rear," "above," "below" and so on are used in the generally accepted form and with reference to the object in its usual use position. This means that, for the weapon, the muzzle of the barrel is at the "front," that the bolt or bolt carrier group is moved "rearward" by the explosive gas, etc. Transverse to a direction substantially means a direction rotated by 90°.

The charging handle assembly of the present disclosure can have any combination of the following features:

- the charging handle has two handles which are mounted on a charging handle assembly body so as to be rotatable about pins;
- the handles are pushed about the pins into their idle position by at least one handle spring;
- at least one handle has a gate-like control surface which, when moving into the work position, deflects a control element fixed to the housing in order to release a displacement of the charging handle assembly body along the weapon median plane;
- the control element is designed to be resiliently deflectable between a locking position and a release position;
- the charging handle assembly body comprises a mating protrusion for interaction with the handle, in particular a control surface formed on the handle and/or a deflection stop;
- the charging handle assembly body is mounted on or in a charging handle carriage which is arranged axially in front of the bolt carrier and is movable in the axial direction;
- the charging handle assembly body is mounted in the charging handle carriage so as to be displaceable normal (i.e., perpendicular) to the weapon median plane;
- the charging handle assembly body is held in the charging handle carriage by a locking mechanism;
- the charging handle assembly body has a locking recess for interaction with the spring-preloaded locking mechanism which is formed on the charging handle carriage;
- at least one handle has a recoil spring entraining device which is designed to protrude on the handle in order to interact with the recoil spring assembly in the work position and grip it temporarily;
- if there is contact between the charging handle carriage and the bolt carrier, when the handle is actuated into the work position the recoil spring entraining device engages in a recess in the recoil spring assembly, for example in a casing of the recoil spring, which corresponds to a forward position;
- in the foremost position of the charging handle carriage, the recoil spring entraining device is pivoted out of the recess in the recoil spring by returning the handle to the idle position.

Selected embodiments of the present disclosure, in particular those that facilitate the use, and in particular the pushing forward of the charging handle, may include any combination of the following features:

- the orientation of the slot holes for the pins attached to the charging handle assembly body, i.e. the slot hole direction, extend in the unfolded position, i.e. the work position of the handles, normal to the barrel axis or weapon median plane;
- when the relevant handle is pushed forward in the work position, a portion of its contour, preferably the control surface, abuts a contact region of the charging handle assembly body and/or a mating protrusion and prevents folding into the idle position;
- the handle has a control surface which is arcuate in plan view and can be supported in the work position on the mating protrusion in the direction of the weapon median plane;
- the control surface has a ramp or gate shape which rises along the arch shape in order to cause the control element fixed to the housing to be pushed in the vertical direction when the handle is actuated into the work position;
- at least one handle has a slot hole with a slot opening;
- at least one handle has a hook which substantially surrounds the slot hole and is formed up to the slot opening.

The arrangement according to the present disclosure of a slot hole on the handle and its mounting about pins allows a limited deflection between an idle position and a work position. The pin can be mounted after the handle is pushed onto the charging handle assembly body or, in a special embodiment with an open slot hole, the pin can also be integrally formed on the charging handle assembly body and mounting is carried out by pushing the handle on, as explained below. The deflection between the idle and work position made possible by the slot hole in any case also allows the handle to be displaced within limits, which allows a temporary locking effect of the handle to reciprocate the recoil spring assembly and/or to mount the handle without tools.

In a preferred embodiment, the slot hole has a slot hole direction which, in the idle position of the handle, is formed at an opening angle of from 5° to 85°, preferably between 20° and 70°, relative to the weapon median plane. As a result, when the handle is actuated forward, i.e. when the bolt is closed manually, there is an effective force transmission from the handle to the pin and thus to the charging handle assembly body.

Furthermore, it can be advantageous that, in a work position of the handle, the slot hole direction is normal (perpendicular) to the weapon median plane. This also allows effective force transmission to the charging handle assembly body when the handle is actuated in the work position—regardless of the selected shape of the handle.

At least one handle spring may be arranged on the charging handle assembly body in order to push the handle or handles into the idle position. The handle spring can be designed as a spiral, leaf or preferably as a bow spring, as a result of which somewhat more complicated geometries are possible, and the total number of required components can be reduced. In particular, it is advantageous to arrange only one handle spring on the charging handle assembly body for preloading both handles in the direction of their idle position.

To interact with the handle, or also a control surface formed thereon, it has proven advantageous to provide a mating protrusion on the charging handle assembly body. This mating protrusion can serve as a stop for a deflection stop of the handle and/or as a central contact surface for the handle in the direction of the weapon median plane in the work position. In this way, a locking effect can be generated for the handle in the work position and a lateral displacement of the handle is avoided.

In a further embodiment, an above-mentioned deflection stop can be arranged on the handle in such a way that inadvertent "over-deflection" of the handle beyond the work position is blocked, since the deflection stop is supported on the charging handle assembly body and/or the mating protrusion.

It has proven to be particularly advantageous if an imaginary extension of the deflection stop extends in parallel with the slot hole direction of the relevant handle. The deflection stop can be designed as a protrusion or as a step. An imaginary axis through the deflection stop or also along the step is particularly preferably designed to be aligned with the slot hole direction. This allows a very slim and thus weight-saving design.

In order to prevent the charging handle assembly from going along with the bolt carrier each time a shot is fired, a control element can be provided on or in the upper receiver of the rifle. Said control element can interact with the charging handle assembly body in such a way that it controls a locking effect or also a release of the charging handle assembly in parallel with the barrel direction. The actuation, i.e. the "activation," of the control element takes place via a functionally complementary control surface on the handle. The control element can be preloaded in the vertical direction as a lock by means of spring elements, or it can already be designed integrally as a resilient control element, for example as a leaf spring. The control surface on the handle has a bevel which, when the handle is rotated, deflects the control element in the vertical direction and thus allows the charging handle assembly to be displaced in the barrel direction. Such a combination of the control surface and control element allows a significant reduction in components and relatively simple operation.

In order to further facilitate the operation and mounting of the handle, in a special embodiment a slot opening of the slot hole can also be provided which allows the handle to be pushed on over the pins.

In a particularly preferred embodiment, the handle has a hook which extends around the slot hole. This hook-shaped protrusion allows the handle spring to be pushed in the mounting position and thus serves to increase user-friendliness.

Furthermore, a locking recess can be provided on the charging handle assembly body, which, with a spring-preloaded locking mechanism, allows automatic locking in the installation position of the charging handle assembly body in the charging handle carriage. As a result, even when the weapon is otherwise assembled, the charging handle assembly body can be pushed laterally into a charging handle assembly seat of the charging handle carriage provided for this purpose. This allows a very high level of operator comfort and very quick actuation or mounting of the charging handle assembly.

The shape of the handles on the charging handle assembly body can be adapted to the respective requirements by a person skilled in the art, or even the shooter, with knowledge of the present disclosure. In particular, the design of the actuation surfaces or the shape of the handles can be optimized in advance by the mounting (or removal) according to the present disclosure by means of a slot hole that is partially open to the outside and can be relatively easily adapted by the shooter to the particular situation. Thus, for example, it is possible to vary between handles of different lengths and shapes, or even a "dummy handle" or cover grip on one side, thus achieving high versatility of the charging handle assembly.

At this point, reference should be made to the content of the as yet unpublished European patent application EP19201448, in which a very similar principle for a charging handle is disclosed.

As can be seen from FIG. 1, a purely schematic representation in the weapon median plane 32, a rifle, when fully equipped and viewed functionally, has for example a barrel 1, a gas drive 2, a barrel extension 3, an upper receiver, also referred to as an upper 4 even outside the USA, a carrier 5, which in turn has guides 6 for a bolt carrier group 7 and/or a charging handle assembly 8 and/or other functional elements, a handguard 9, a lower receiver, also referred to as a lower 10, which in turn comprises, a magazine release 11, a trigger assembly 12, a grip 13, a bolt catch device 14, a central lock 15, a magazine 16, and a buttstock/shaft 17.

All of these parts do not always have to be present, or their design can vary slightly depending on the application, such as in hunting weapons, but on the other hand other parts can also be added, for example mounting elements for riflescopes, for laser pointers, and the like. It is also possible for some of said components to be inseparably formed together on a more complex component, such as the lower receiver 10 in the case shown, and so the illustration is only one example of a highly modular rifle.

With the aid of the following illustration, and on the basis of several preferred embodiments of the charging handle assembly 8 according to the present disclosure, the structure and sub-functions of this assembly will be presented by way of example in sections.

Figure 2:
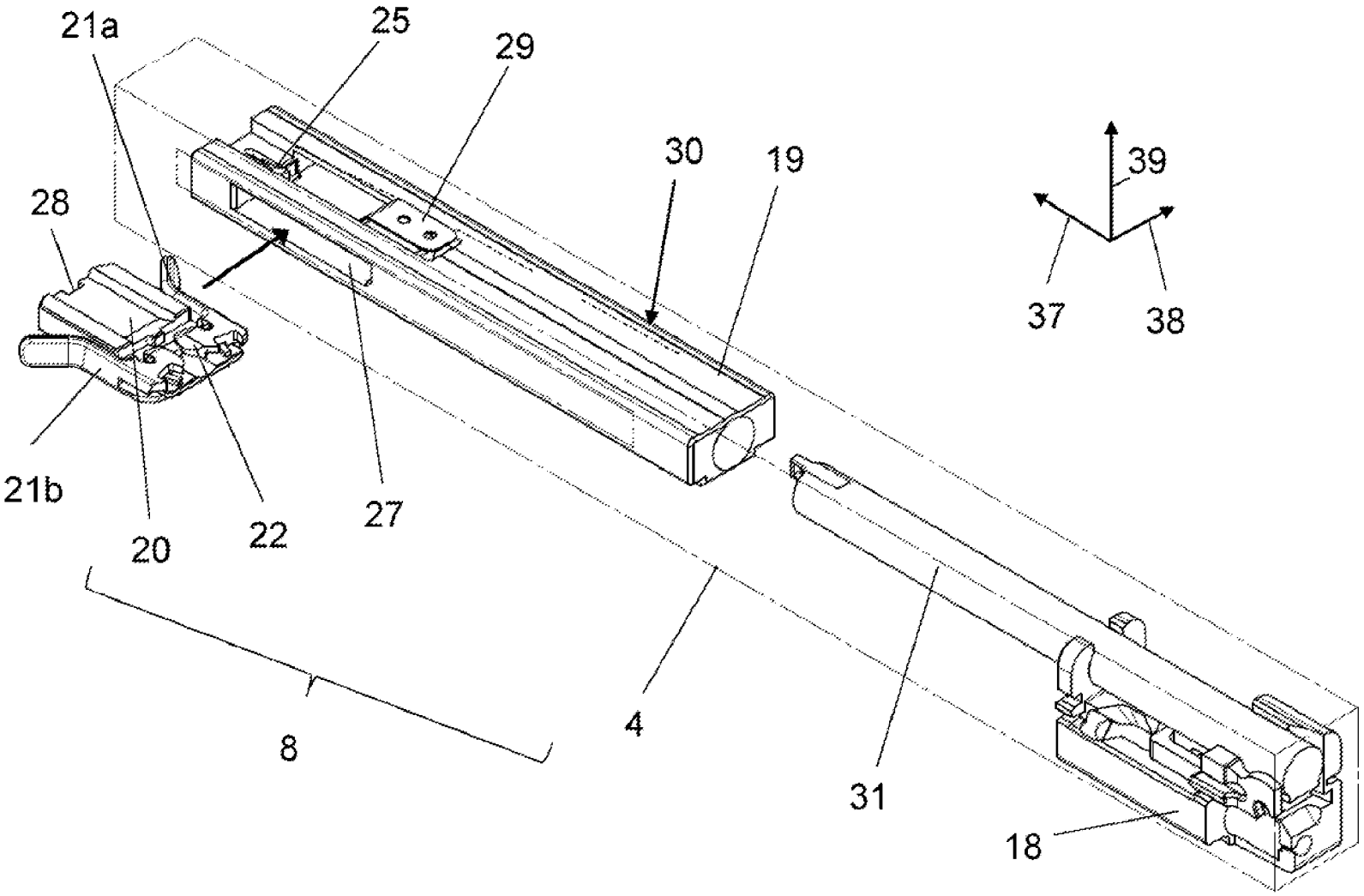
FIG. 2 shows the installation situation of an exemplary charging handle assembly according to the present disclosure in an oblique view.

Basic Function of the Charging Handle Assembly 8:

FIG. 2 is a schematic perspective view of an embodiment of an exemplary charging handle assembly 8 according to the present disclosure. Only the components of the firearm that are essential for the charging handle assembly 8 are shown, namely a bolt carrier 18, a recoil spring assembly 31, and a charging handle carriage, or carriage 19 for short. This has a charging handle assembly seat 27 in its front region. Said charging handle assembly seat 27 can be completely open at the top or, as shown, can be partially limited by a window in the transverse direction 38 and/or vertical direction 39. The charging handle assembly body 20 can thus, as indicated by the movement arrow, be inserted laterally into the carriage 19 in the transverse direction 38, normal to the weapon median plane 32.

As can be seen from FIG. 2, an upper receiver 4 is also indicated, in which the charging handle assembly 8 is arranged so as to be displaceable in or counter to the barrel direction/axis 37. In this way, a cartridge can be loaded into the cartridge chamber of a barrel 1 against the force of the recoil spring in a manner known per se. Due to the design and arrangement of the charging handle assembly 8 according to the present disclosure, the handles 21 can also be automatically folded into the idle position, and a manual reciprocal movement of the bolt carrier 18 can be achieved. The axis system used is shown with the axes or directions in the barrel direction/axis 37, transverse direction 38 and vertical direction 39, for clarification. Reference should be made here to the slightly different design, explained further below, of the two cheeks or control surfaces 22 of the handles 21*a,b* in the mutually facing end region.

Figure 3:
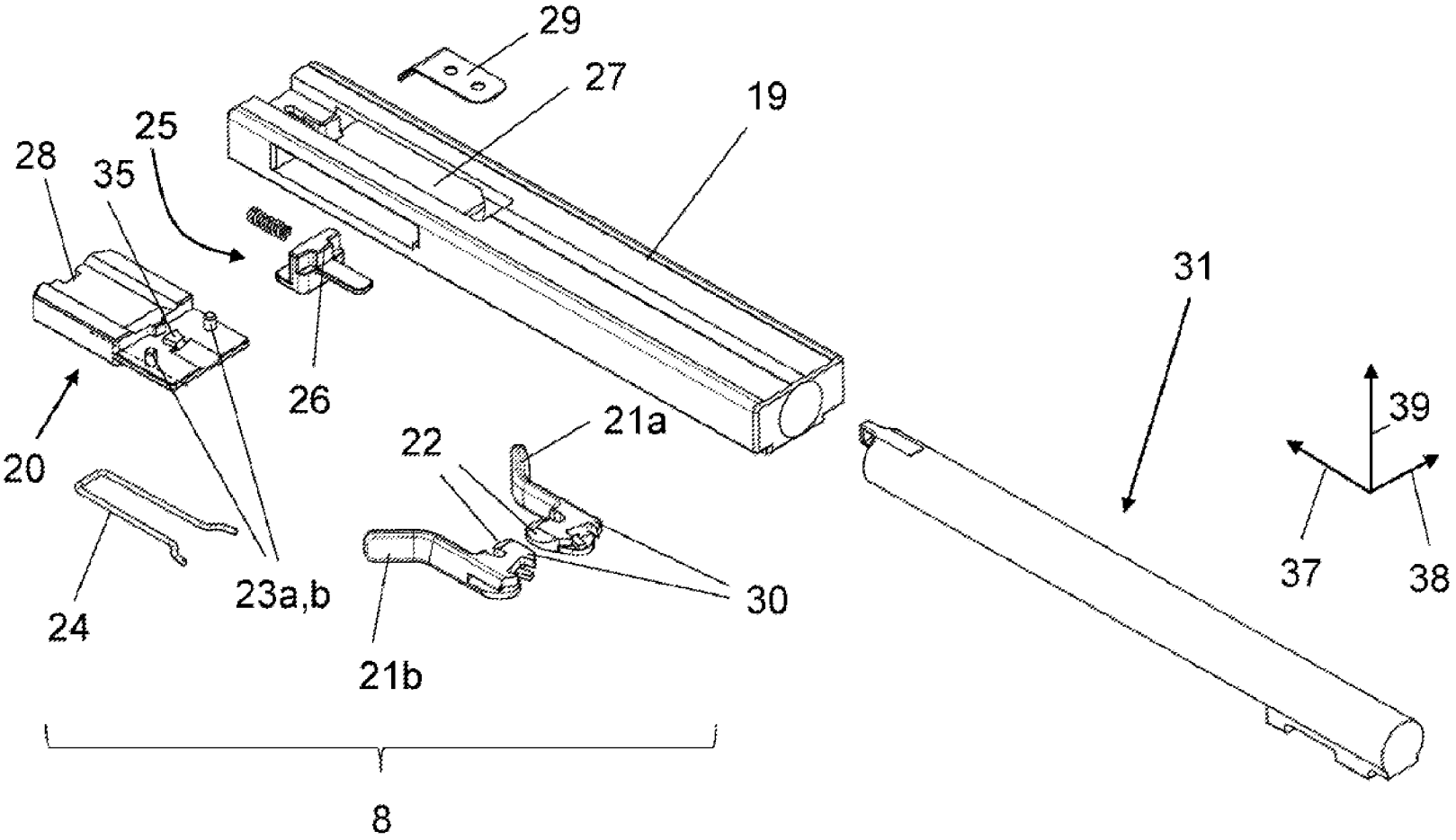
FIG. 3 is an exploded view of the charging handle from FIG. 2.

FIG. 3 is a schematic exploded view of the exemplary charging handle assembly 8 and a recoil spring assembly 31. The charging handle assembly body 20 has two pins 23*a,b*, the axes of which extend in the vertical direction 39. The pins 23*a,b* can be mounted on the charging handle assembly body 20 or preferably also formed integrally thereon. Two handles 21*a,b* which are pivotally mounted about the pins 23*a,b* are shown opposite one another. Furthermore, a handle spring 24 can be seen which, in the embodiment shown, can be inserted from below into the charging handle assembly body 20 in order to push the handles 21*a,b* in the direction of their idle position.

Lateral Installation of the Charging Handle Assembly 8:

Looking at FIG. 3 together with FIG. 2 and FIGS. 5A-5D, a locking mechanism 25 can be seen which, after the charging handle assembly body 20 has been inserted, automatically engages in a locking recess 28 provided for this purpose on the charging handle assembly body 20 with the aid of a spring-preloaded locking protrusion 26. The locking protrusion 26 can be released when the upper receiver 4 is open or when the rifle is partly dismantled simply by actuating the locking mechanism 25, as a result of which the charging handle assembly body 20 can be pushed out of the carriage 19 in the transverse direction 38. It is also possible to reverse the direction of action, for example by arranging the locking mechanism 25 with its spring-preloaded locking protrusion 26 in the charging handle assembly body 20, and the corresponding locking recess 28 on the carriage 19.

From the exploded view of FIG. 3 in conjunction with FIGS. 2, 5A-5D and 6A-6C, the position of the control element 29 mounted on the upper receiver 4 can also be assigned. The mode of action is explained in more detail below.

Figure 4:
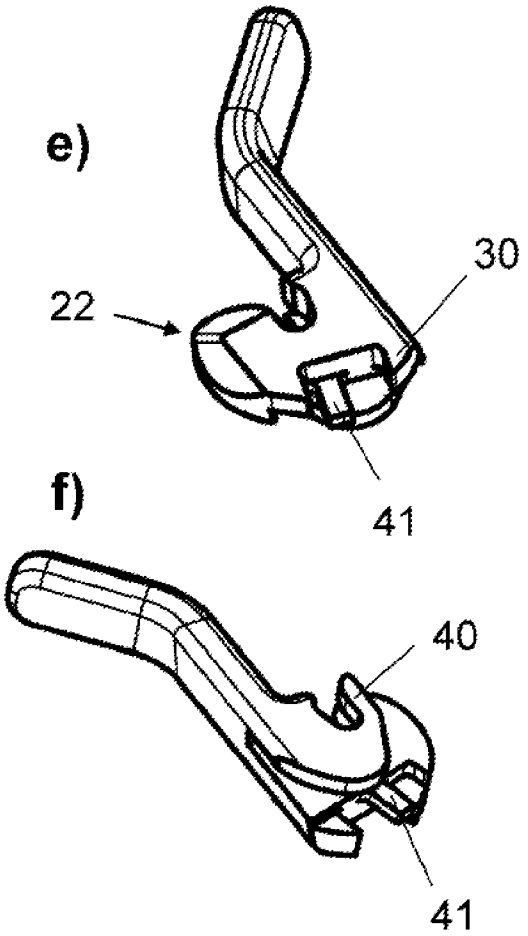
FIGS. 4A-4F depict an embodiment of a handle in a view from above (FIG. 4A), from the side (FIG. 4B), from the front (FIG. 4C), from below (FIG. 4D), and at an angle from above (FIG. 4E) and below (FIG. 4F)
Figure 4:
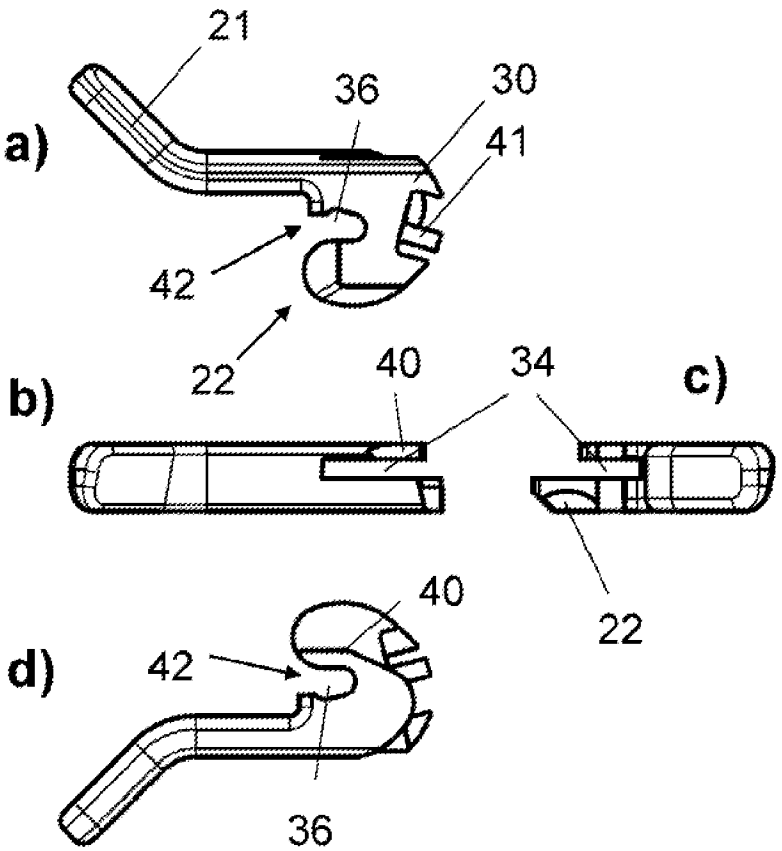

Form and Function of an Exemplary Handle 21:

FIGS. 4A-4F include a top view from above (FIG. 4A), a side view (FIG. 4B), a front view (FIG. 4C), and a bottom view (FIG. 4D). FIGS. 4E and 4F show a handle 21 in a perspective view obliquely from above and below. The handle 21 can have a straight, curved or, as illustrated in the selected embodiment, an arcuate actuating element. The handle 21 has a slot hole 36, which is shown in the following illustrations as a preferred embodiment by means of a slot hole 36 that is partially open to the outside. The slot hole 36 is open laterally to the outside by means of a slot opening 42 in one end region. The slot opening 42 substantially corresponds to the diameter of the pin 23. The longitudinal extent of the slot hole 36 is referred to as the slot hole direction 33; cf. FIGS. 8A-8D. FIGS. 4B and 4C very clearly show a notch 34 which allows the handle 21 to be pushed onto the charging handle assembly body 20 and thus allows a very small overall lateral extension of the charging handle assembly 8 in the transverse direction 38.

A closed slot hole 36 is also technically possible, but the following advantages with regard to the particularly simple mounting/removal do not apply since the handles 21 would first have to be placed on the charging handle assembly body 20 and fixed in their position by means of the pins 23.

Mounting/Removal Process:

FIGS. 4A, 4D, 4E, and 4F very clearly show the central position of the slot hole 36, which passes through the handle 21 in the vertical direction 39. Starting from the notch 34, the underside has a hook shape. The handle 21 thus has, in the region of the hook 40, smaller lateral dimensions on the underside than on the upper side which is behind—when viewed in the bottom view of FIG. 4*d*—and where the control surface 22 clearly has a kind of curve shape. The hook 40 delimits the slot hole 36 and extends as far as the slot opening 42. The flattened shape of the underside in the form of the hook 40 allows the handle spring 24 to have a good contact surface, as can be seen very clearly in conjunction with FIGS. 7A-7D.

Figures 7A, 7B, 7C, 7D:
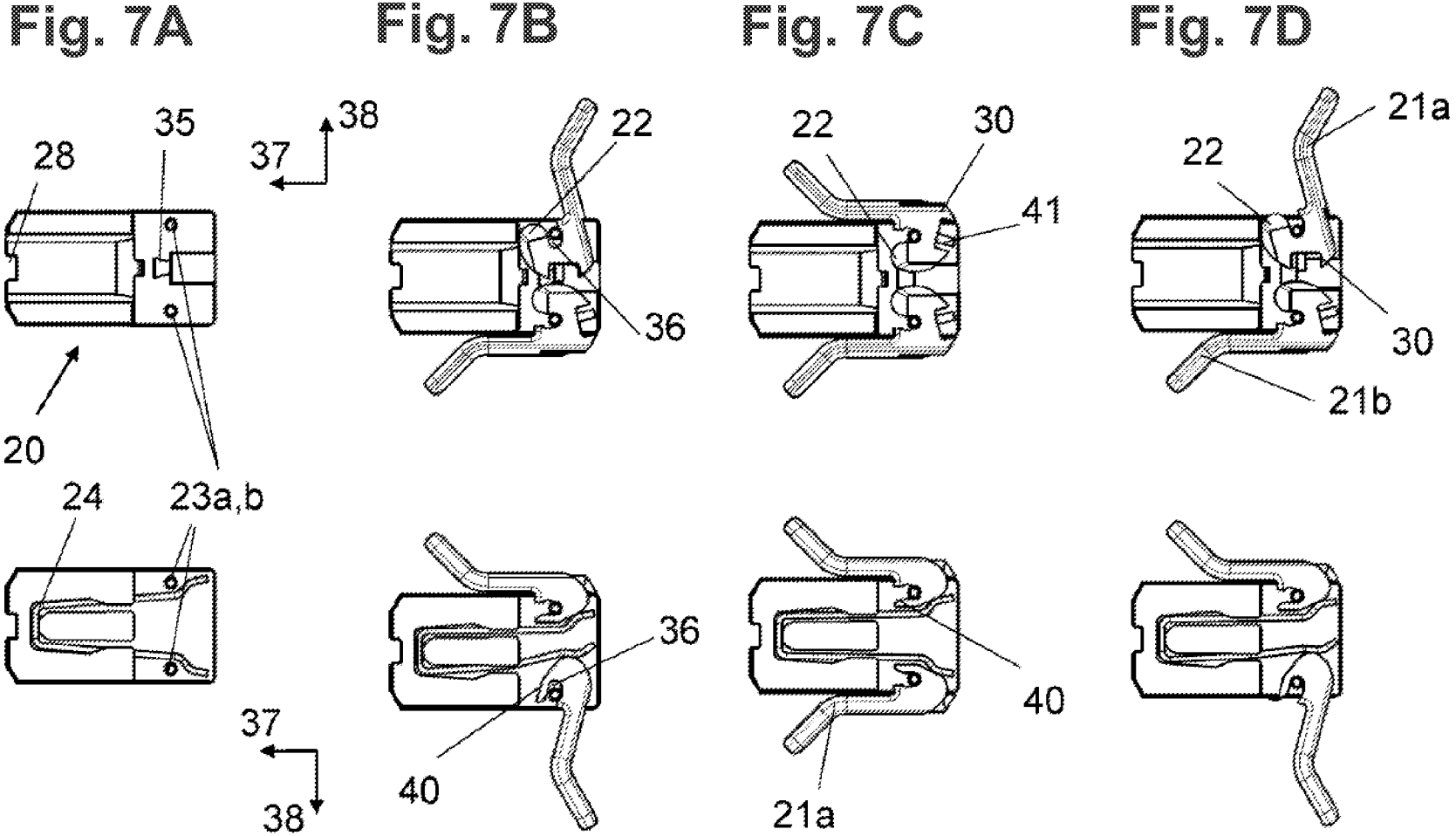
FIGS. 7A-7D schematically show an exemplary charging handle assembly body of the present disclosure with a handle spring and handles in different positions in a top view (upper row of images) and a bottom view (lower row of images)

In FIGS. 7A-7D, a charging handle assembly body 20 comprising a handle spring 24, mounted pins 23 and handles 21 can be seen in different positions. The top row of FIGS. 7A-7D shows a top view, and the bottom row shows a bottom view. FIG. 7A shows the charging handle assembly body 20 and the handle spring 24 which is inserted into a receiving opening on the underside. In the installation situation, the spring action pushes the two legs of the spring apart in the transverse direction 38. If a handle 21 is then pushed onto the charging handle assembly body 20 from behind when said assembly is removed, the pin 23 is received in the slot hole 36 through the slot opening 42. During this mounting process, the handle spring 24 is pushed "inward" by the hook 40 in the direction of the weapon median plane 32 and the spring action causes the handle 21 to be folded into its idle position; see FIG. 7C. In the work position, FIG. 7D, the pin 23 is mounted in the end region of the slot hole 36 that is further away from the slot opening 42.

As can also be seen from FIGS. 7A-7D, the charging handle assembly body 20 has a centrally arranged mating protrusion 35. This serves as a lateral guide for the control surface 22 and, in the example shown, is designed to complement the shape of the rounding of the control surface 22. A small clearance on the underside of the control surface 22 toward the notch 34 allows mounting/removal as described above when the charging handle assembly body 20 is removed, since the clearance allows a displacement via the mating protrusion 35. In the installation position in the carriage 19, however, such a displacement in or counter to the barrel direction/axis 37 is no longer possible and the handle 21 can still only be pivoted between the idle and work position, or within the limits of the slot hole 36 into a retrieval position explained below.

Locking Effect of the Control Element 29 and Function of the Control Surface 22:

The locking effect of the control element 29 against undesired movement of the charging handle assembly 8 when the shot is fired can be carried out in a simplified manner as follows. As can be seen clearly in FIGS. 5A and 5B in cross-sectional and perspective views, the control element 29 is preloaded downward in the vertical direction 39. The control element 29 prevents a backward displacement counter to the barrel direction/axis 37 since a locking edge 43 provided on the charging handle assembly body 20 blocks the movement with the control element 29. The handle 21 in FIGS. 5A and 5B is folded, i.e. in the idle position.

Figure 5:
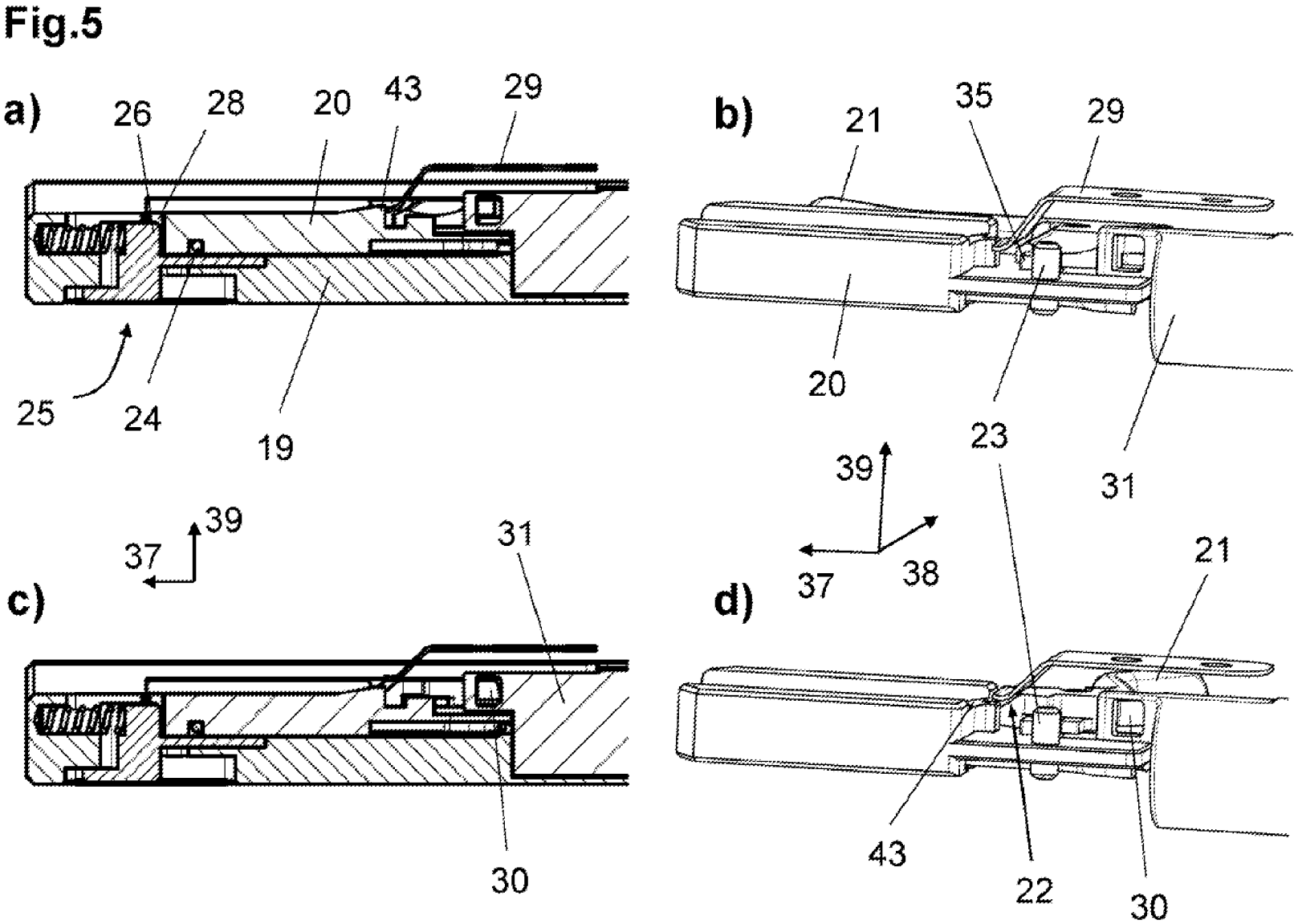
FIGS. 5A and 5C show the charging handle from FIG. 2 in a cross section in different positions.
FIGS. 5B and 5D show corresponding oblique views.

If the handle 21 is then pivoted into the work position, the control surface 22 which is formed on the upper side of the handle 21 and rises in the manner of a ramp or gate causes a vertical deflection of the control element 29, as can be clearly seen from FIGS. 5C and 5D. The locking edge 43 is therefore no longer in engagement with the control element 29 and the charging handle assembly 8 can be pulled backward counter to the barrel direction/axis 37. The carriage 19 transmits the longitudinal movement to the bolt carrier 18 counter to the force of the recoil spring assembly 31; cf. FIG. 2. After releasing the handle 21 in the rearmost position, the handle 21 automatically folds back into the idle position due to the previously described action of the handle spring 24 and the charging handle assembly 8 is accelerated forward. The control element 29 springs back into the locking position and the movement of the charging handle assembly 8 is thus avoided during (semi-) automatic firing.

Figure 6:
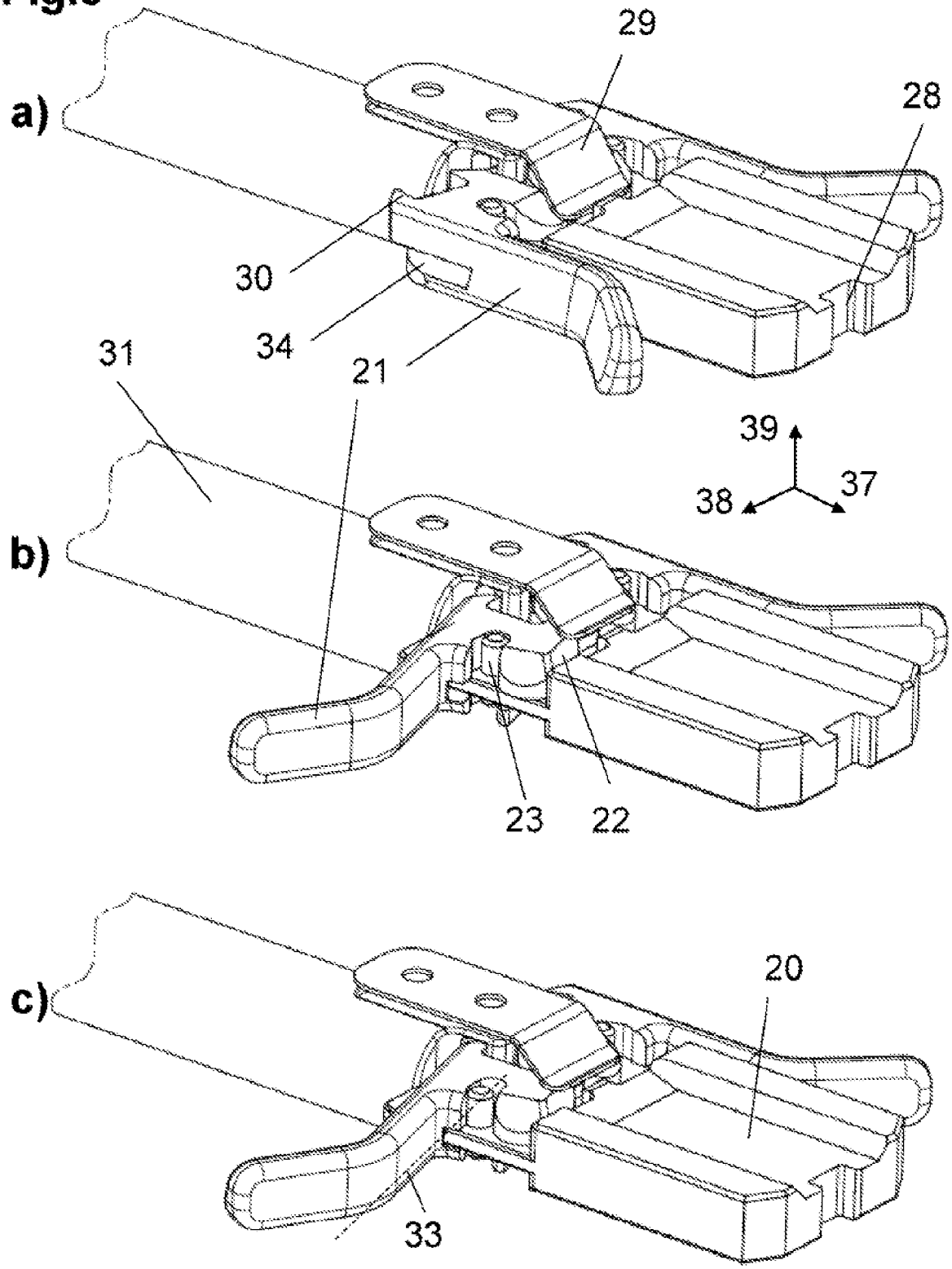
FIGS. 6A-6C show the charging handle assembly without a carriage in the idle position (FIG. 6A), in the work position (FIG. 6B) and in the forward position (FIG. 6C)

Manual Closing Movement (Forward Assist):

The charging handle assembly 8 according to the present disclosure can also be used for the manual closing movement; see the sequence diagrams in FIGS. 6A to 6C which represent a perspective view. In FIG. 6A, the handle 21 is in the idle position, and the control element 29 is in the locking position with respect to the charging handle assembly body 20. In FIG. 6B, the handle 21 is in the work position, meaning the above-mentioned release of the charging handle assembly 8 can take place backward, counter to the barrel direction/axis 37. In FIG. 6C, the handle 21 is slightly deflected in the direction of the weapon median plane 32 in a retrieval position in its slot hole direction 33. This displacement is made possible substantially by the shape and orientation of the slot hole 36 or its orientation to the weapon median plane 32. Looking at FIGS. 3 and 5A-5D together, a recess in the recoil spring assembly 31 can be seen in which the handle 21 can engage in the retrieval position by means of a nose-shaped recoil spring entraining device 30 (see also FIGS. 4A-4F, for example). Due to the suitable shape and arrangement of the control surface 22, the slot hole 36, the slot hole direction 33, as well as the recoil spring entraining device 30, the recoil spring assembly 31 is thus automatically "gripped" when the charging handle assembly 8 is returned to the rearmost position and can be pushed forward in the barrel direction/axis 37 by pressing the handle 21. The pressure of the retrieval movement is transmitted from the control surface 22 and/or the deflection stop 41 and/or the pin 23 to the charging handle assembly body 20, as result of which the load on the pin 23 can be relieved.

In a preferred embodiment, the handle 21 has a deflection stop 41. The deflection stop 41 can be seen very clearly in FIGS. 4A and 4E, for example, and is primarily used to reduce undesired excessive deflection of the handle 21 beyond the work position. The deflection stop 41 can preferably be arranged between the control surface 22 and the recoil spring entraining device 30 and limits the pivoting movement of the handle 21 by striking the mating protrusion 35, as can be clearly seen from an overview of FIGS. 8A-8D, in the lower row of images.

It was also found to be advantageous for the orientation of the slot hole direction 33 to largely coincide with the longitudinal extent of the deflection stop 41, or even to be in alignment therewith. This relationship is particularly clear in FIGS. 8A-8D, which shows different handles 21 on the charging handle assembly body 20 in the idle position (upper row of images) or the work position (lower row of images). Furthermore, it can be clearly understood from FIGS. 8A-8D that—depending on the design of the slot hole direction 33—the handle 21 can be deflected to different extents in the work position and consequently protrudes laterally from the upper receiver 4. However, it is advantageous if the deflection stop 41 in the work position is fully supported on the mating protrusion 35 (cf. FIGS. 8A, 8B and 8C, lower row of images). This is made possible by the fact that the slot hole direction 33 is oriented normal to the weapon median plane 32 in the work position. The orientation of the slot hole direction 33 relative to the weapon median plane 32 can be described by the opening angle 45. It is thus possible to provide different handles 21 with different opening angles 45 in order to offer the user several options to choose from.

Figure 8:
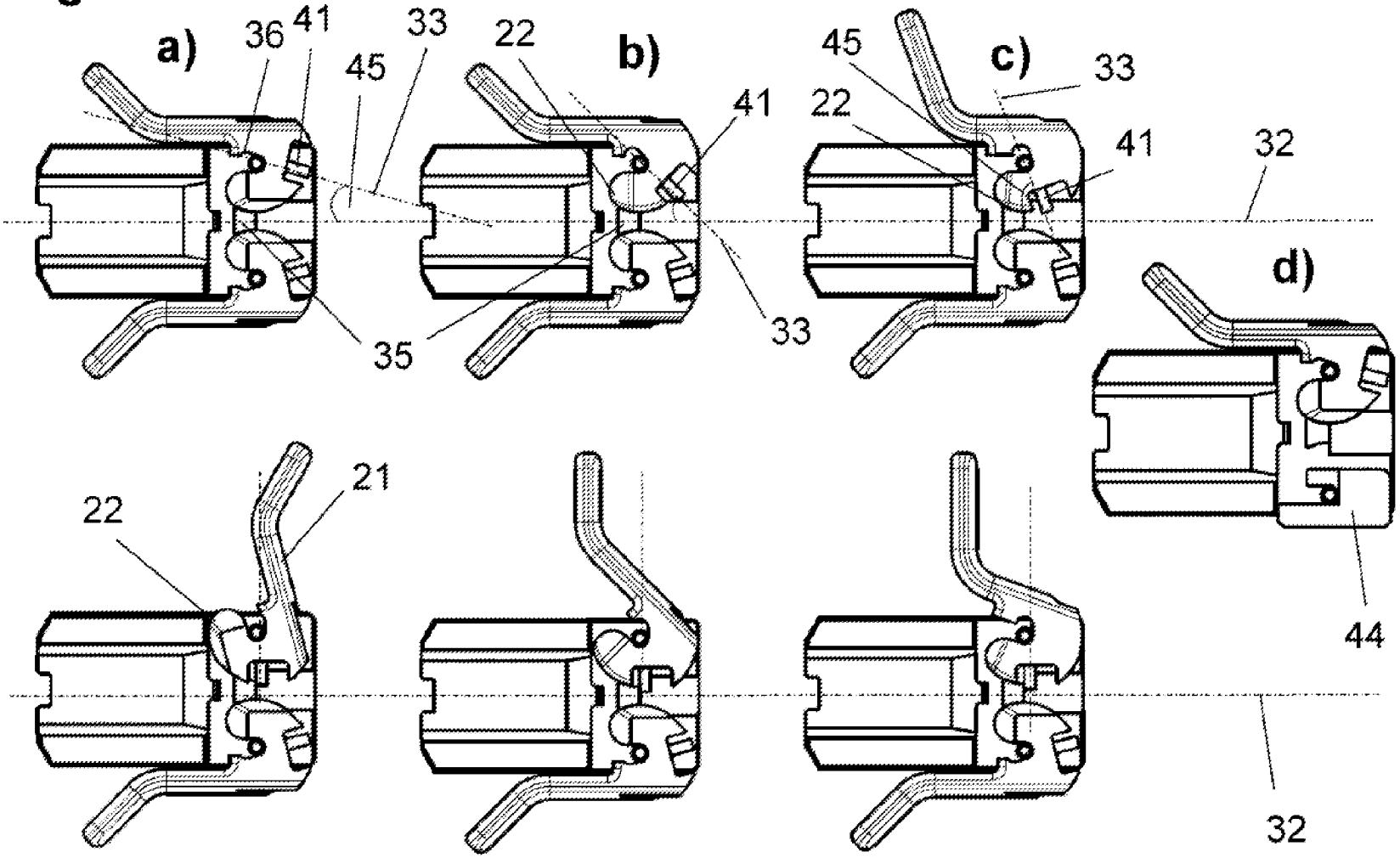
FIGS. 8A-8D show an exemplary charging handle assembly of the present disclosure in a top view with embodiments of different handle variants, in the idle position (upper row of images) and the work position (lower row of images).

Furthermore, FIG. 8D shows a special embodiment according to which a cover grip 44 is pushed onto the charging handle assembly body 20. The mounting/removal of such a "hidden" and therefore functionless handle is carried out analogously to the description above. Said cover grip 44 can be used to obtain a charging handle assembly 8 that can only be operated from one side and, at the same time, to reduce the risk of penetration of foreign bodies into the interior of the charging handle assembly 8.

Terms such as the "lower region" of a component or device or, more generally, an object, refer to the lower half and in particular the lower quarter of the overall height; "lowermost region" refers to the lowermost quarter and in particular an even smaller part, while "central region" refers to the central third of the overall height (or width-length). All these terms have their generally accepted meaning, applied to the intended position of the object under consideration.

In the description and the claims, "substantially" means a deviation of up to 10% of the stated value, if physically possible, both downward and upward, otherwise only in the appropriate direction; in the case of degrees (angle and temperature), this means ±10°.

With terms such as "a spring," the word "a" is not to be considered to represent a singular numeral, but rather is to be considered an indefinite article or pronoun, unless the context indicates otherwise.

The term "combination" or "combinations" means, unless stated otherwise, all types of combinations, starting from two of the relevant components up to a large number or even all of such components; the term "containing" also means "consisting of." Statements such as "more than three" include and disclose any individual number greater than three.

The features and variants stated in the individual embodiments and examples can easily be combined with those of the other examples and embodiments and in particular can be used for characterizing the disclosed charging handle in the claims without necessarily including the other details of the particular embodiment or of the particular example.

In conclusion, the following is established: The invention relates to a rifle with a weapon median plane 32, comprising a barrel 1 with a barrel direction/axis 37, a gas drive 2, a bolt carrier 18, a recoil spring assembly 31 and a charging handle assembly 8 arranged in front of the bolt carrier 18, with handles 21*a,b* rotatably mounted about pins 23*a,b* being pushed into their idle position by at least one handle spring 24*b*. By forming a slot hole 36 on the handle 21, the charging handle assembly body 20 can be displaced in both the pulling and the pushing direction in or counter to the barrel direction/axis 37. By optimizing the design of the handle 21 or the orientation of at least the slot hole 36, the deflection of the handle 21 in the lateral direction can easily be optimized for various applications by a person skilled in the art.

The charging handle assembly 8 according to the invention is mounted on a carriage 19 which is arranged axially in front of the bolt carrier 18 and is movable in the axial direction, and said assembly and can be pushed in or removed from the side relatively easily.

| List of reference signs: | |
|---|---|
| 1 | Barrel |
| 2 | Gas drive |
| 3 | Barrel extension |
| 4 | Upper receiver or upper |
| 5 | Carrier module |
| 6 | Guiding means |
| 7 | Bolt carrier group |
| 8 | Charging handle assembly |
| 9 | Handguard |
| 10 | Lower receiver or lower |
| 11 | Magazine release |
| 12 | Trigger assembly |
| 13 | Grip |
| 14 | Bolt catch device |
| 15 | Central locking system |
| 16 | Magazine |
| 17 | Buttstock/shaft |
| 18 | Bolt carrier |
| 19 | (Charging handle) Carriage |
| 20 | Charging handle assembly body |
| 21 | a, b (Charging handle) Handle(s) |
| 22 | Control surface |
| 23 | a, b Pin (s) |
| 24 | Handle spring |
| 25 | Locking mechanism |
| 26 | Locking protrusion |
| 27 | Charging handle assembly seat |
| 28 | Locking recess |
| 29 | Control element |
| 30 | Recoil spring entraining device/catch |
| 31 | Recoil spring assembly |
| 32 | Weapon median plane |
| 33 | Slot hole direction |
| 34 | Notch |
| 35 | Mating protrusion |
| 36 | Slot hole |
| 37 | Barrel direction |
| 38 | Transverse direction |
| 39 | Vertical direction |
| 40 | Hook |
| 41 | Deflection stop |
| 42 | Slot opening |
| 43 | Locking edge |
| 44 | Cover grip |
| 45 | Opening angle |

The invention claimed is:

1. A firearm having a weapon median plane, the firearm comprising:

a barrel with a barrel direction;

a gas drive;

a bolt carrier;

a recoil spring assembly; and a charging handle assembly arranged in front of the bolt carrier;

wherein the charging handle assembly has at least one handle that is mounted on the charging handle assembly body so as to be rotatable about a corresponding pin, and which is pushed by at least one handle spring about the corresponding pin into its idle position; and where the charging handle assembly body is mounted in a carriage that is arranged axially in front of the bolt carrier and is movable in the axial direction; and wherein the at least one handle defines a slot hole having a slot opening that is configured for slidably receiving the corresponding pin and mounting the at least one handle thereupon.

2. The firearm according to claim 1, wherein the slot hole has a slot hole direction, such that when the handle is in an idle position, the slot hole direction relative to the weapon median plane defines an opening angle that is from 5° to 85°.

3. The firearm according to claim 1, wherein the slot hole has a slot hole direction, such that when the handle is in an idle position, the slot hole direction relative to the weapon median plane defines an opening angle that is between 20° and 70°.

4. The firearm according to claim 1, wherein when the at least one handle is in a work position, the slot hole direction is normal to the weapon median plane.

5. The firearm according to claim 1, further comprising a mating protrusion that is arranged on the charging handle assembly body.

6. The firearm according to claim 1, further comprising a deflection stop formed on the at least one handle in a direction of the weapon median plane.

7. The firearm according to claim 6, wherein the deflection stop defines an imaginary axis that is parallel with the slot hole direction.

8. The firearm according to claim 6, wherein the deflection stop defines an imaginary axis that is in alignment with the slot hole direction.

9. The firearm according to claim 1, wherein the at least one handle includes a control surface for interaction with a control element that is arranged in an upper receiver of the firearm, the control element being resiliently deflectable.

10. The firearm according to claim 1, wherein the at least one handle can be mounted to and removed from the charging assembly body without a tool.

11. The firearm according to claim 10, wherein the at least one handle, when viewed in an installation situation, includes a hook delimiting the slot hole and the slot opening on its underside.

12. The firearm according to claim 1, wherein the charging handle assembly body is configured to be inserted into the carriage in a transverse direction and be fastened by a locking mechanism.

13. The firearm according to claim 12, wherein the locking mechanism includes a locking protrusion that is spring-preloaded in parallel with a barrel direction/axis and which is designed to complement the shape of a locking recess formed on the charging handle assembly body.

14. The firearm according to claim 1, having two handles, and further comprising a handle spring configured to preload both handles in a direction of their idle position, the handle spring being arranged on the charging handle assembly body.

15. The firearm according to claim 1, having two handles, wherein the two handles have different shapes and are arranged on the charging handle assembly body.

16. The firearm, according to claim 15, wherein one of the two handles is configured to act as a cover grip.

* * * * *